US011794964B2

(12) United States Patent
Turner et al.

(10) Patent No.: US 11,794,964 B2
(45) Date of Patent: Oct. 24, 2023

(54) ASSEMBLY FOR DISPENSING LIQUIDS

(71) Applicant: TRISTEL PLC, Newmarket (GB)

(72) Inventors: Jeremy Turner, Omokoroa (NZ); Paul Swinney, Newmarket (GB); Elizabeth Dixon, Newmarket (GB); Thomas Brand, Newmarket (GB); Elanor Dixon, Newmarket (GB)

(73) Assignee: TRISTEL PLC, Newmarket (GB)

( * ) Notice: Subject to any disclaimer, the term of this patent is extended or adjusted under 35 U.S.C. 154(b) by 403 days.

(21) Appl. No.: 16/768,796

(22) PCT Filed: Dec. 21, 2018

(86) PCT No.: PCT/GB2018/053741
§ 371 (c)(1),
(2) Date: Jun. 1, 2020

(87) PCT Pub. No.: WO2019/135065
PCT Pub. Date: Jul. 11, 2019

(65) Prior Publication Data

US 2021/0171253 A1 Jun. 10, 2021

(30) Foreign Application Priority Data

Jan. 2, 2018 (GB) ..... 1800024

(51) Int. Cl.
*B65D 51/28* (2006.01)
*B65D 25/20* (2006.01)

(52) U.S. Cl.
CPC ..... *B65D 51/2814* (2013.01); *B65D 25/20* (2013.01); *B65D 51/2878* (2013.01)

(58) Field of Classification Search
CPC ..... B65D 51/2821; B65D 51/2814; B65D 51/2835; B65D 81/3238; B65D 51/2878; B65D 25/08; B65D 25/20
(Continued)

(56) References Cited

U.S. PATENT DOCUMENTS 5,346,105 A 9/1994 Onneweer
8,356,711 B2 * 1/2013 Canziani Hoffa . B65D 51/2828 206/535
(Continued)

FOREIGN PATENT DOCUMENTS

EP 2014563 A1 1/2009
JP H05-71137 U 9/1998
(Continued)

*Primary Examiner* — Steven A. Reynolds
(74) *Attorney, Agent, or Firm* — Hayes Soloway PC

(57) ABSTRACT

An assembly (2) for dispensing liquids comprises: • a base member (8); • a cap (4) on the base member (8); and • a dispensing capsule (6) in the base member (8) and covered by the cap (4). The dispensing capsule (6) comprises: • a capsule body (7) having a first end (16) and a second end (18); • at least one wall (20) defining a first cavity (38) within the capsule body, the first cavity (38) having a first opening at the first end (16) of the capsule body; • at least one wall (22) defining a second cavity (40) within the capsule body, the second cavity (40) having a second opening at the first end (16) of the capsule body; • the first opening and the second opening provided with a seal member (64) which seals the first cavity (38) and the second cavity (40). The walls of the first cavity and the second cavity are collapsible if pressure is applied to the cavities from the second end (18) of the capsule body.

14 Claims, 6 Drawing Sheets

(58) Field of Classification Search
USPC ..... 206/222, 219
See application file for complete search history.

(56) References Cited

U.S. PATENT DOCUMENTS

| | | | | |
|---|---|---|---|---|
| 8,839,982 | B1 * | 9/2014 | Anderson | B65D 51/2835 220/267 |
| 8,960,424 | B1 * | 2/2015 | Anderson | B65D 51/2835 206/219 |
| 10,450,117 | B1 * | 10/2019 | Turner | B65D 81/3222 |
| 2009/0065379 | A1 | 3/2009 | Casey | |
| 2010/0258457 | A1 * | 10/2010 | Seelhofer | B65D 51/2821 206/222 |
| 2012/0193362 | A1 * | 8/2012 | Porter | B65D 51/2864 220/521 |
| 2013/0326996 | A1 | 12/2013 | Colaprete et al. | |
| 2014/0027322 | A1 * | 1/2014 | Fontana | B65D 51/2821 206/219 |
| 2014/0124394 | A1 * | 5/2014 | Guillon | B65D 81/32 53/452 |
| 2015/0251837 | A1 * | 9/2015 | Krammer | B65D 51/2835 53/474 |
| 2017/0107028 | A1 * | 4/2017 | Frosio | B65D 1/0246 |
| 2017/0355496 | A1 * | 12/2017 | Seelhofer | B65D 51/2835 |

FOREIGN PATENT DOCUMENTS

| | | | |
|---|---|---|---|
| JP | 2012-245987 | A | 12/2012 |
| WO | 2005011756 | A1 | 2/2005 |
| WO | 2005028322 | A1 | 3/2005 |
| WO | 2014064414 | A1 | 5/2014 |
| WO | 2017060677 | A1 | 4/2017 |

* cited by examiner

ASSEMBLY FOR DISPENSING LIQUIDS

CROSS-REFERENCE TO RELATED APPLICATIONS AND PRIORITY

This patent application claims priority from PCT Patent Application No. PCT/GB2018/053741 filed Dec. 21, 2018, which claims priority from Great Britain Patent Application No. 1800024.0 filed Jan. 2, 2018. Each of these patent applications are herein incorporated by reference in its/their entirety.

BACKGROUND a. Field of the Invention

The present invention relates to an assembly for dispensing liquids, notably for dispensing a disinfectant composition, and to apparatus including the assembly.

b. Related Art

Many liquid preparations include active ingredients which degrade over time, limiting product shelf life. This is particularly true for disinfectants or sterilising agents such as chlorine dioxide, where the active ingredient is formed in situ when required by mixing two reagents. Examples are disclosed in WO 2005/011756. Chlorine dioxide, for example, may be formed by mixing a chlorite solution and an acid.

It is known to provide a dispensing capsule for location in the neck of a vessel, the capsule having two internal chambers, each containing a reagent. Discharging of the contents of the chambers into the vessel allows the reagents to mix and generate the active ingredient. Examples of such a dispensing capsule are described in WO 2017/060677. The dispensing capsule has two or more sealed dispensing chambers each of which contains a different substance to be dispensed into a primary chamber. Screwing a cap onto the neck of the vessel causes progressive crushing of the walls of the dispensing chambers and breaks an internal seal between the chambers, permitting pre-mixing of the contents of the chambers. Further crushing of the walls as the cap is screwed down results in breaking of an external seal, permitting discharge of the mixture into the primary chamber. The pre-mixing accelerates formation of the active agent, but it is desirable to further accelerate this formation to reduce the time needed to form an adequate concentration of active agent in the primary chamber.

After dispensing of the pre-mixed contents, the user unscrews the cap and must then remove the dispensing capsule from the neck of the vessel. The removal can be difficult as the capsule is typically a tight fit to ensure a good seal. The crushed dispensing capsule should then be properly recycled. However, re-use of the crushed capsule may be attempted, by pushing up the crushed cavity walls, refilling each cavity and resealing the capsule. This re-use is undesirable because the integrity of the cavity walls may have been compromised by the crushing, producing leakage and premature mixing. Also, the new seal may not perform within specification, for example by fracturing or delaminating too soon, or by not permitting sufficient time for pre-mixing. This can reduce efficiency and provide less surface complete disinfection, which is a particular problem in clinical environments.

SUMMARY OF THE INVENTION

Aspects of the invention are specified in the independent claims. Preferred features are specified in the dependent claims.

The invention provides an assembly for dispensing liquids, which provides additional pre-mixing time for concentrated reagents to react together prior to being discharged into the primary chamber.

A preferred embodiment of the invention provides an assembly for dispensing liquids, which may be ergonomically actuated and which is removable from the neck of a vessel by a single action of pulling or unscrewing. The assembly may be locked in a configuration in which re-use is prevented.

BRIEF DESCRIPTION OF THE DRAWINGS

The invention will now be further described, by way of example only, with reference to the following drawings in which.

DETAILED DESCRIPTION

Figure 1:
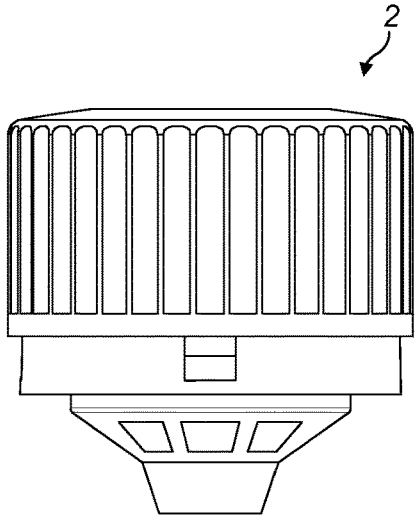
FIGS. 1 and 2 show side and perspective views of an assembly for dispensing liquids, in accordance with an embodiment of the present invention.
Figure 2:
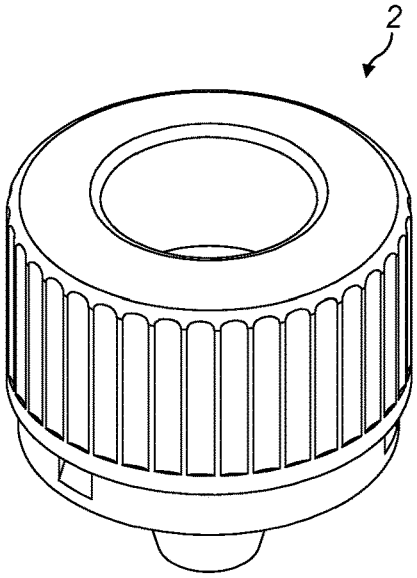
Figure 3:
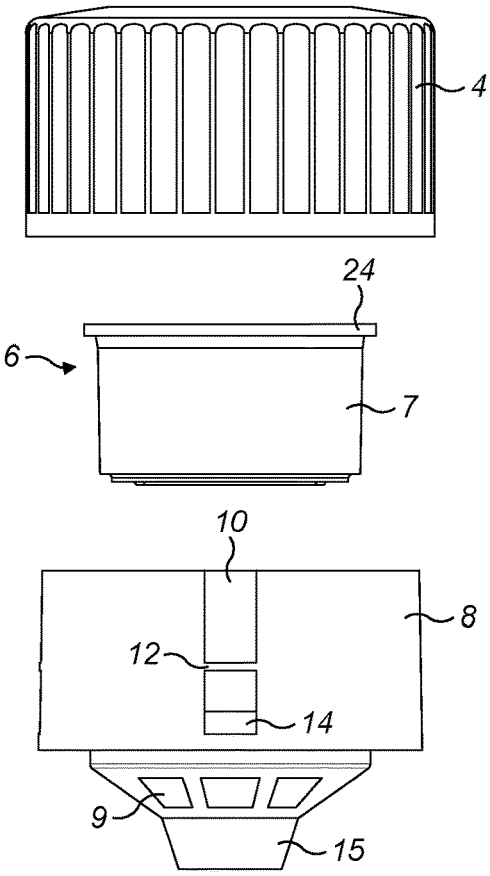
FIGS. 3 and 4 are exploded views corresponding to FIGS. 1 and 2, respectively, of the assembly.

The assembly 2 for dispensing liquids shown in FIGS. 1-4 comprises a base member 8, a cap 4 which is axially slidable on the base member 8, and a dispensing capsule 6 in the base member 8 and covered by the cap 4.

The dispensing capsule 6 comprises a capsule body 7 having a first end 16 and a second end 18. In this embodiment the capsule includes a flange 24 at the second end of the capsule body, which sits on an annular seat 26 in the base member 8. In this embodiment, the flange 24 is interrupted by a production key detail 36 which is used to locate the capsule during filling and sealing operations.

Figure 5:
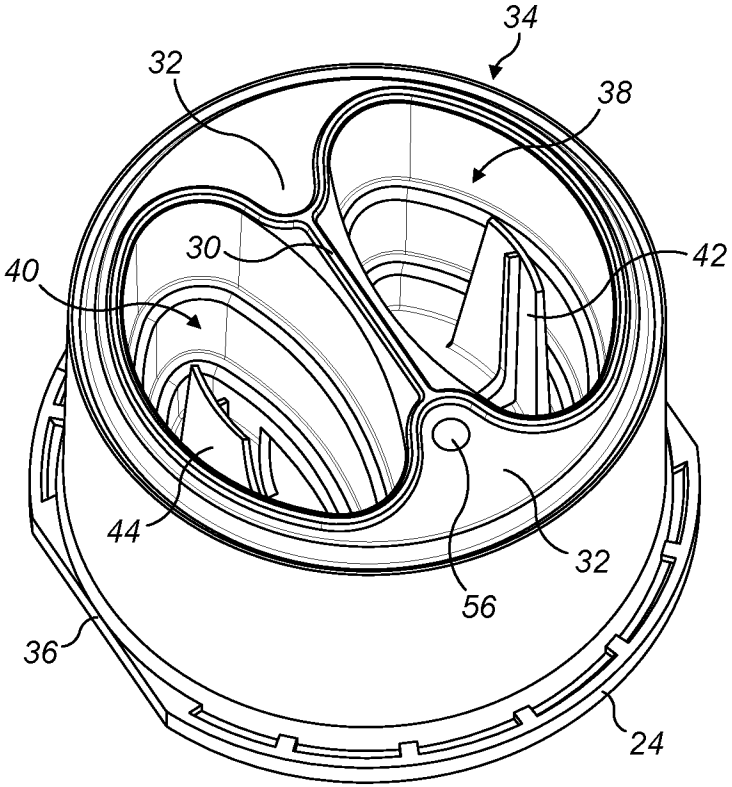
FIGS. 5 shows a capsule body for use in making an assembly in accordance with an embodiment of the invention.
Figure 4:
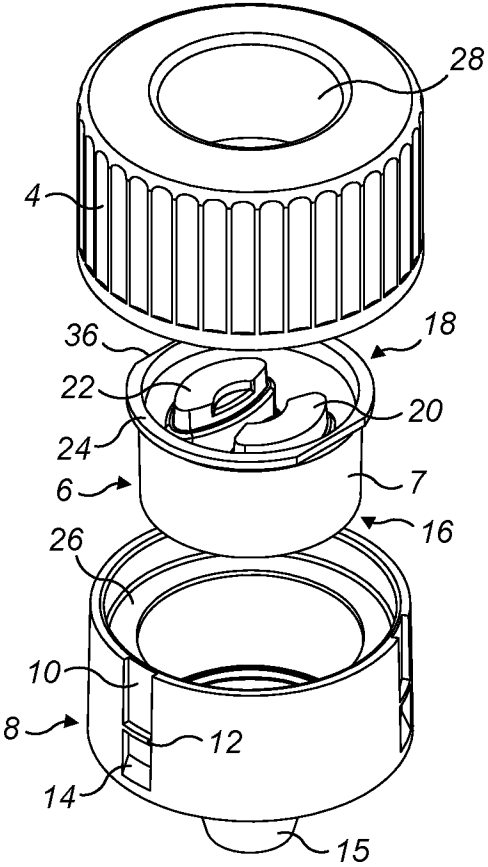

The capsule body 7 has at least one wall 20 defining a first cavity 38 and at least one wall 22 defining a second cavity 40 (FIG. 5). The cavities 38, 40 have first and second openings, respectively, at the first (dispensing) end 16 of the capsule. Each cavity contains a liquid and is covered by a seal member 64 which seals the contents of each cavity from the other cavity. Each cavity 38, 40 may be provided with a separate seal member, or a single seal member 64 may cover both cavities, for example as disclosed in WO 2017/060677, which provides for pre-mixing of the contents of the cavities before breaking of the seal between the seal member 64 and the peripheral wall around the base 34 of the capsule body.

The walls of the first cavity 38 and the second cavity 40 are collapsible, concertina-style, if pressure is applied to the walls of the cavities from the second end 18 of the capsule body 7. The cap 4 includes a plunger 54, which in this embodiment is at the bottom of an opening 28 in the cap. The plunger 54 will bear against and cause progressive collapsing of the walls of the first cavity and the second cavity if the cap 4 is made to slide by an external force to a dispensing position in which the walls 20, 22 of the cavities 38, 40 are sufficiently collapsed to cause unsealing of the first opening and the second opening. In the embodiment shown in FIG. 5, a single seal member (not shown) may cover substantially the entire lower surface 34. A dividing member 30 is disposed between two internal projections 32 at the first end. A depression 56 helps reduce adhesion of the seal member at one end of the dividing member 32. As pressure increases within the cavities, a critical pressure is reached at which the bond between the seal member and the dividing member 30 breaks, allowing the seal member to deform into a dome and permit partial mixing of the contents of the cavities while the bond between the seal member and the peripheral wall around the base 34 remains intact. The contents may, for example, be reagents which when mixed produce a disinfectant composition; for example chlorine dioxide or peracetic acid. Suitable reagents will be well known to those skilled in the art; for example, reagents for producing chlorine dioxide include: chlorite and acid; chlorate, peroxide and acid; and chlorite, hypochlorite, and a suitable buffer. The reagents may be in a concentrated form, providing rapid formation of the active agent when the contents of the chambers are mixed.

In this embodiment, the first and second cavities 38, 40 have respective burst pins 42, 44. As pressure is increased, further collapse of the walls 20, 22 of the cavities 38, 40 brings the tips of the burst pins into contact with the seal member 64 and then causes the burst pins to push against the seal member to break the bond at the outer periphery, allowing pre-mixed contents of the capsule body 7 to be dispensed in a controlled manner. Alternatively, the burst pins could cause rupturing of the seal, or the burst pins could be omitted and application of sufficient pressure alone could be used to cause unsealing or bursting of the seal member, thereby releasing the contents of the cavities.

The base member 8 in this embodiment has an outer wall 46 and an inner wall 50 which defines an opening. The capsule 6 sits in the space defined by the inner wall 50. A screw thread 48 is provided on an inner-facing surface of the outer wall 46, for securing the assembly to the neck of a vessel.

Figure 13:
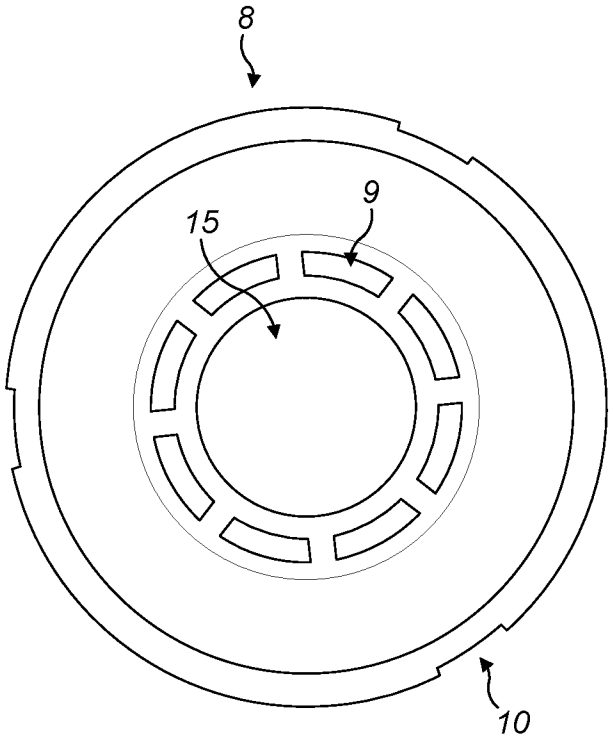
FIGS. 12 and 13 are, respectively, a side elevational and a top plan view of the base member of the assembly of FIG. 3.
Figure 12:
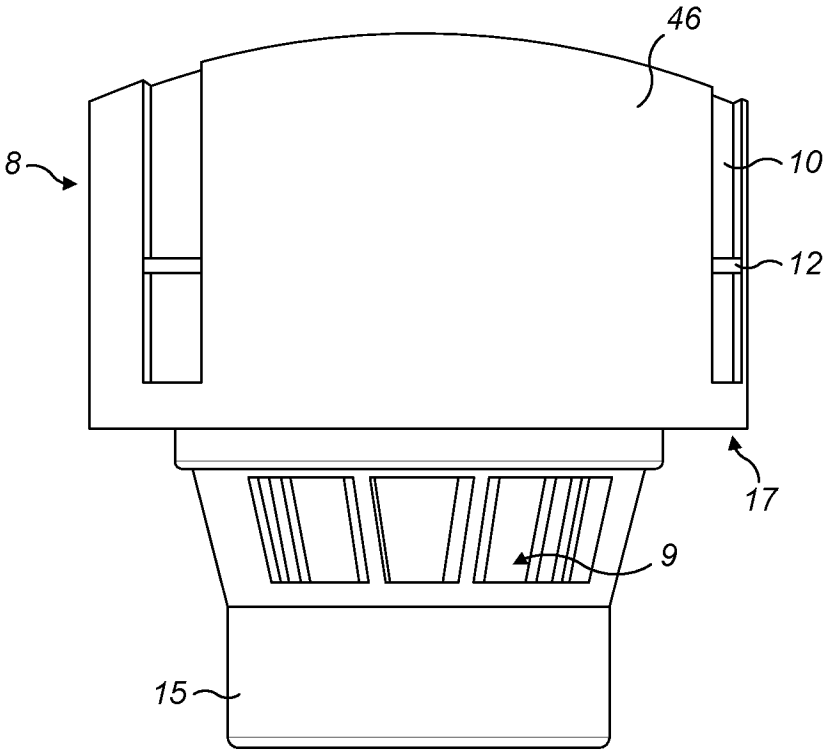

The base member 8 is provided with a cup member 15 (best shown in FIGS. 12 and 13) for receiving liquids discharged from the capsule 6 when the seal 64 has been displaced or broken. The concentrated reagents from the capsule remain in the cup and can rapidly react to provide the disinfecting agent before the user causes liquid (for example, water) from the primary chamber to wash through the cup member 15 via drain openings 9 in one or more side walls adjacent the cup member 15.

Figure 6:
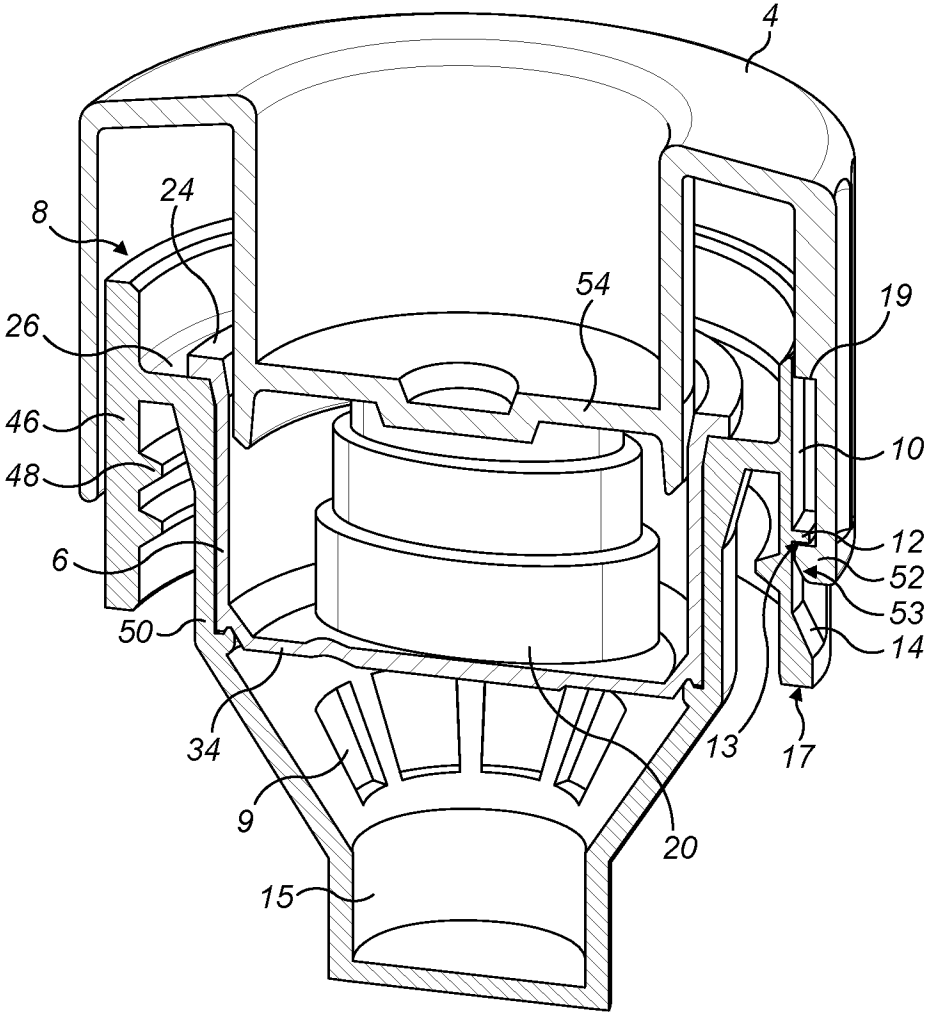
FIG. 6 is a sectional view through the assembly of FIG. 1, with the cap in the loaded position.

The cap 4 and the base member 8 are provided with first mutually interengageable locking members arranged and adapted to prevent or inhibit removal of the cap 4 from the base member 8 when the cap is in a loaded position with the plunger 54 over the first cavity 20 and the second cavity 22 with the cavities sealed. In this embodiment, the base member 8 is provided with three external axial grooves 10 (two of which are visible in FIG. 4) each of which has a projecting ridge 12. For each groove 10, the cap 4 has a corresponding inward-projecting catch or detent 52. The detent 52 is hook-like and has a bevelled or chamfered inner-facing edge 53. As the cap 4 is pushed onto the base member 8, the chamfered edge 53 passes over the ridge 12 and the detent 52 flexes outwardly. When the trailing edge of the detent 52 passes over the ridge 12, the detent 52 snaps into place at a location 13 within the groove 10 beneath the ridge 12, as best shown in FIG. 6. In this loaded position, the assembly resists removal of the cap, which would require simultaneous outward flexing of each detent 52. The cavities remain sealed in the loaded position.

Figure 7:
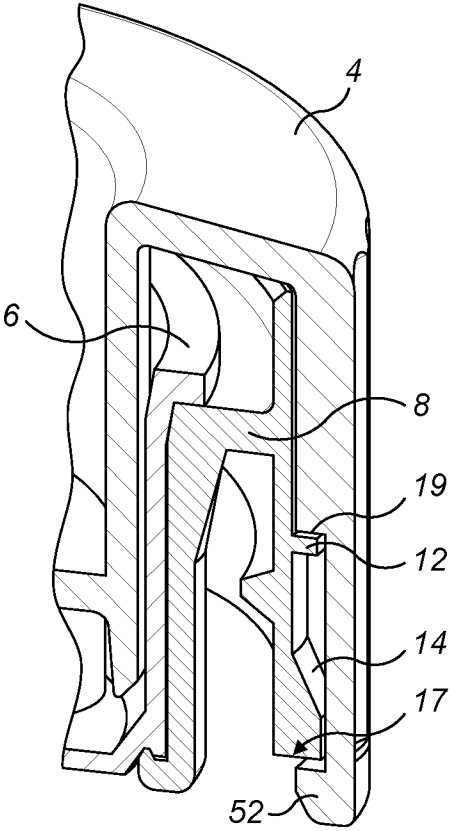
FIG. 7 is a sectional view corresponding to the right hand side of the assembly shown in FIG. 6, with the cap in the dispensing position.

Application of sufficient further force to the cap 4 will cause the plunger 54 to bear against and cause progressive collapse of the walls of the first cavity and the second cavity as the cap is made to slide to a dispensing position in which the walls of the cavities are sufficiently collapsed to cause unsealing of the first opening and the second opening. As the cap moves from the loaded position to the dispensing position, the detent 52 travels over a ramp portion 14 and flexes outwardly. At the dispensing position (FIG. 7) the detent snaps into place against a lower surface 17 of the base member 8. Here, the detent 52 and surface 17 comprise second mutually interengageable locking members arranged and adapted to prevent or inhibit removal of the cap from the dispensing position on the base member. Also in this embodiment, an inner shoulder 19 on the cap bears against an upper surface of the ridge 12 when the cap is in the dispensing position, preventing further downward travel of the cap. The assembly is fixed in the dispensing position.

Figure 8:
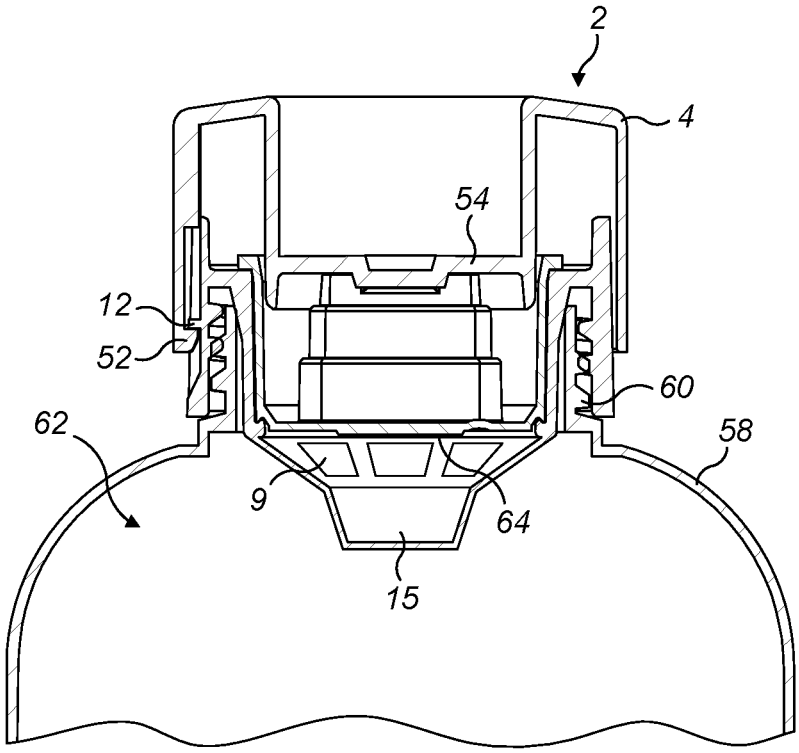
FIGS. 8 and 9 show partial sectional views of apparatus for mixing liquids, according to an embodiment of the present invention.
Figure 9:
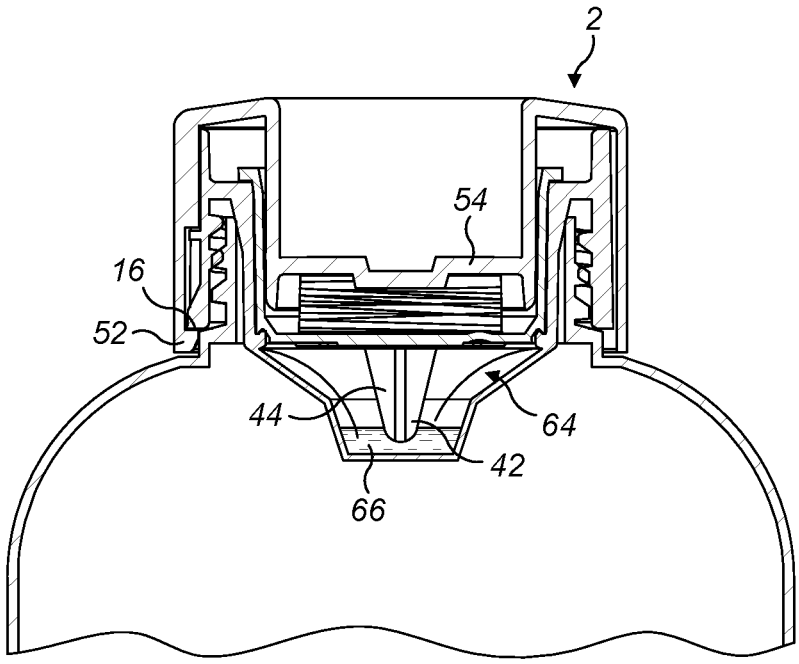

Referring now to FIGS. 8 and 9, an embodiment of an apparatus for mixing liquids comprises a vessel 58 having a primary chamber 62 and a neck 60 in which is disposed the assembly 2. The seal member 64 is in fluid communication with the cup member 15 and the primary chamber 62. In this example, the assembly 2 is releasably secured to the neck 60 by the screw thread 48 on the base member 8 and a complementary screw thread on the neck 60. In FIG. 8, the cap 4 is in the loaded position and the seal 64 is intact. Application of external pressure on the cap 4 pushes the cap to the dispensing position shown in FIG. 9. Crushing of the walls of the cavities causes unsealing of the openings of the cavities, in this example by the action of the burst pins 42, 44 on the sealing member 64. Liquids 66 from the cavities enter the cup member 15, where they react to form a disinfectant. The liquids may, for example, be an acid and a chlorite solution which react to form a chlorine dioxide solution. Pre-mixing of the concentrated reagents in the cup 15 produces the active reagent more rapidly than if the reagents are added separately, or after only a relatively short pre-mixing time, to water in the primary chamber.

After waiting a predetermined time for the reagents to mix in the cup 15, the user inverts or shakes the vessel 58, causing water in the primary chamber 62 to enter through drain openings 9 and mix with the contents of the cup 15. The vessel 58 may be at least partially filled with a liquid such as water prior to securing of the assembly on the neck, in a suitable quantity so that the resulting solution has a desired concentration of active agent. When mixing has taken place, the resulting solution (aqueous chlorine dioxide, in this example) may be dispensed. In this example, the vessel 58 is a bottle, and chlorine dioxide solution is dispensed by unscrewing the assembly 2 to remove it from the vessel neck, and pouring the solution out through the neck. Alternatively, the assembly could be replaced by a sprayer head with a dip tube, and the contents of the vessel could be dispensed by spraying.

Figure 11:
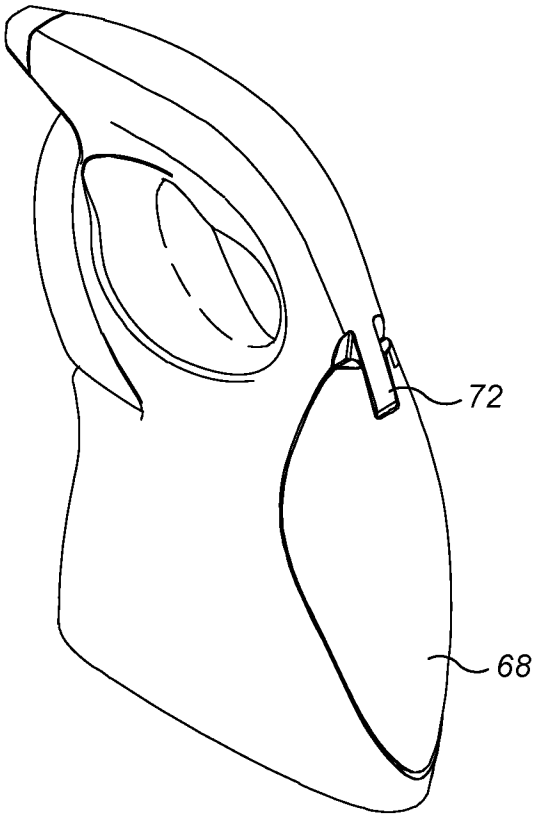
FIGS. 10 and 11 are perspective views of apparatus for mixing liquids according to a further embodiment of the invention, with the lever in the first position and the second position.
Figure 10:
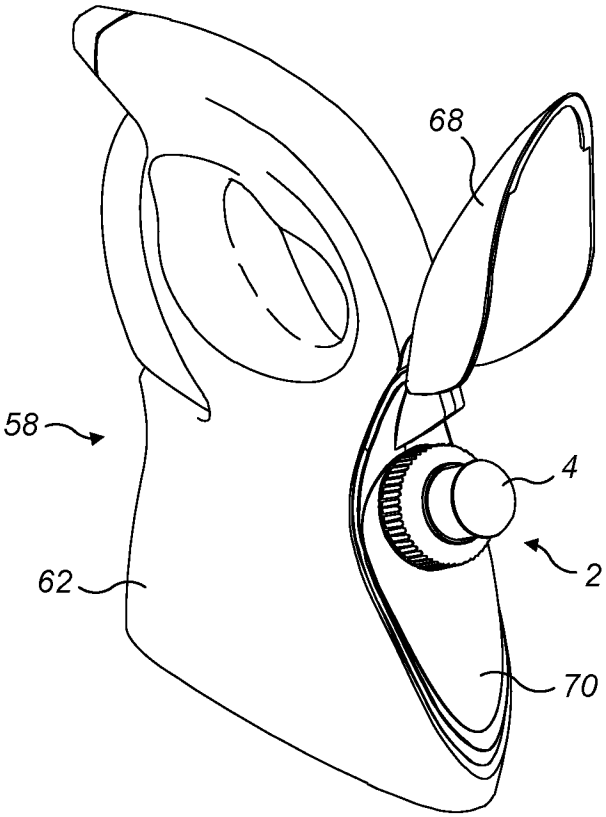

In the further embodiment of the apparatus shown in FIGS. 10 and 11, the vessel 58 is a trigger sprayer, for example of a type described in WO 2014/064414. The assembly 2 is secured to a neck of the sprayer bottle with the cap 4 in the loaded position. The trigger sprayer is provided with a lever 68 which is pivotable between a first position (FIG. 10) in which the lever 68 does not bear against the cap 4, and a second position (FIG. 11) in which the lever bears against the cap in the dispensing position. The lever 68 is manually pivoted by the user about a hinge 72 until it is in contact with a surface 70 on the vessel 58. In this embodiment, the lever completely covers the cap when the lever is in the second position. This Class 2 lever provides a mechanical advantage, and enables the user to exert greater force via the lever than by applying finger pressure directly to the cap.

In a preferred embodiment the force required to move the cap from the loaded position to the dispensing position is greater than the force required to move the cap to the loaded position. This arrangement can permit the cap to be pushed onto the base member by hand to the loaded position, but prevent or inhibit the accidental pushing of the cap to the dispensing position.

Although the invention has, for convenience, been illustrated with each set of locking members comprising a detent on the cap and one or more ridges or depressions on the base member, the invention is not limited to this arrangement. For example the base member may be provided with a detent, and the cap may be provided with one or more depressions which snap-fit over the detent when the cap is pushed down the base member. In another embodiment, the first (and optionally second or third) locking members may be an annular snap-fit which utilizes hoop-strain to hold the cap in place. Hoop-strain is the expansion of the circumference of the cap (more elastic piece) as it is pushed or twisted onto the base member (more rigid piece).

The invention has been illustrated with axial grooves on the base member. However, it will be understood that the grooves need not be completely straight, providing that the cap can be pushed on the base member. For example, the grooves could have a twist which imparts some rotational movement as the cap is pushed on the base member. In alternative embodiments, the cap may be provided with a groove and the base member with a projection that sits in the groove, or the cap and base member may have complementary screw threads.

The invention claimed is:

1. An assembly for dispensing liquids, the assembly comprising:

a base member;

a cap on the base member; and a dispensing capsule in the base member and covered by the cap;

the dispensing capsule comprising:

a capsule body having a first end and a second end;

at least one first wall defining a first cavity within the capsule body, the first cavity having a first opening at the first end of the capsule body;

at least one second wall defining a second cavity within the capsule body, the second cavity having a second opening at the first end of the capsule body;

the first opening and the second opening provided with a seal member which seals the first cavity and the second cavity;

wherein the at least one first wall and the at least one second wall are collapsible if pressure is applied to the cavities from the second end of the capsule body;

the cap including a plunger which will bear against and cause progressive collapsing of the at least one first wall and the at least one second walls if the cap is made to move by an external force from a loaded position with the plunger over the first cavity and the second cavity with the cavities sealed, to a dispensing position in which the at least one first wall and the at least one second walls- of the cavities are sufficiently collapsed to cause unsealing of the first opening and the second opening, the plunger being fixed to and movable with the cap;

the base member including a cup member for receiving and retaining liquids from the cavities when the first opening and the second opening have been unsealed;

the base member having at least one drain opening disposed at or adjacent the top of the cup member to permit liquid to enter and leave the cup member and the assembly;

wherein the cap and the base member are provided with locking members arranged and adapted to prevent or inhibit removal of the cap from at least one of the loaded position and the dispensing position on the base member.

2. The assembly according to claim 1, wherein the locking members comprise first mutually interengageable locking members arranged and adapted to prevent or inhibit removal of the cap from the loaded position on the base member.

3. The assembly according to claim 1, wherein the locking members comprise second mutually interengageable locking members arranged and adapted to prevent or inhibit removal of the cap from the dispensing position on the base member.

4. The assembly according to claim 1, wherein the locking members comprise first mutually interengageable locking members arranged and adapted to prevent or inhibit removal of the cap from the loaded position on the base member, and second mutually interengageable locking members arranged and adapted to prevent or inhibit removal of the cap from the dispensing position on the base member.

5. The assembly according to claim 4, wherein the force required to move the cap from the loaded position to the dispensing position is greater than the force required to move the cap to the loaded position.

6. The assembly according to claim 2, wherein the first interengageable locking members comprise a projection on one of the cap and the base member, and a ridge or depression on the other of the cap and base member.

7. The assembly according to claim 6, wherein the first interengageable locking members comprise a hook on the cap and a ridge or depression on the base member.

8. The assembly according to claim 3, wherein the second interengageable locking members comprise a hook on the cap and a lower surface of the base member.

9. The assembly according to claim 1, wherein the base member further comprises a screw thread for securing the assembly to the neck of a vessel having a complementary screw thread.

10. The assembly according to any claim 1, wherein the cap is slidable on the base member.

11. An apparatus for mixing liquids, the apparatus comprising a vessel having a primary chamber and a neck in which is disposed an assembly according to claim 1;

the seal member being in fluid communication with the primary chamber.

12. The apparatus according to claim 11, further comprising a lever pivotally mounted on the vessel, the lever being pivotable between a first position in which the lever does not bear against the cap, and a second position in which the lever bears against the cap in the dispensing position.

13. The apparatus according to claim 12, wherein the lever completely covers the cap when the lever is in the second position.

14. The apparatus according to claim 11, wherein the neck of the vessel and the base member of the assembly are secured together by screw threads.

* * * * *